US012516914B2

(12) United States Patent
Speir et al.

(10) Patent No.: US 12,516,914 B2
(45) Date of Patent: Jan. 6, 2026

(54) NET-LAUNCHING SYSTEM

(71) Applicant: Gibson Robotics Ltd, Edinburgh (GB)

(72) Inventors: Dylan Speir, Edinburgh (GB); Joseph Gibson, Edinburgh (GB)

(73) Assignee: GIBSON ROBOTICS LTD, Edinburgh (GB)

( * ) Notice: Subject to any disclaimer, the term of this patent is extended or adjusted under 35 U.S.C. 154(b) by 0 days.

(21) Appl. No.: 18/697,161

(22) PCT Filed: Sep. 30, 2022

(86) PCT No.: PCT/GB2022/052488

§ 371 (c)(1),
(2) Date: Mar. 29, 2024

(87) PCT Pub. No.: WO2023/052788

PCT Pub. Date: Apr. 6, 2023

(65) Prior Publication Data

US 2024/0410679 A1 Dec. 12, 2024

(30) Foreign Application Priority Data

Sep. 30, 2021 (GB) ..... 2114048

(51) Int. Cl.
*F41H 13/00* (2006.01)
*F41A 21/18* (2006.01)
*F42B 10/26* (2006.01)

(52) U.S. Cl.
CPC ..... *F41H 13/0006* (2013.01); *F41A 21/18* (2013.01); *F42B 10/26* (2013.01)

(58) Field of Classification Search
CPC ..... F41H 13/0006; F41A 21/18; F42B 10/26
(Continued)

(56) References Cited

U.S. PATENT DOCUMENTS 3,643,364 A 2/1972 Koch
5,750,918 A * 5/1998 Mangolds ..... F42B 12/66 102/213

(Continued)

FOREIGN PATENT DOCUMENTS

CA 2970243 A1 12/2018
CN 101191712 A 6/2008

(Continued)

OTHER PUBLICATIONS

GB Search Report for GB application No. 2114048.8, dated Dec. 13, 2022, 6 pages.

(Continued)

*Primary Examiner* — Samir Abdosh
(74) *Attorney, Agent, or Firm* — Tarolli, Sundheim, Covell & Tummino LLP

(57) ABSTRACT

An assembly for use as a net-launching projectile is disclosed. The assembly comprises a housing storing a net in a packed configuration and configured such that a rotation of the assembly causes the net to be ejected from the housing, thereby unpacking the net into an expanded configuration. The assembly also comprises a plurality of circumferentially disposed protrusions or ridges for engaging with corresponding rifling in a barrel to induce the rotation of the assembly when launched. Also disclosed is a net-launching system and a method of capturing an aerial target.

14 Claims, 7 Drawing Sheets

(58) Field of Classification Search
USPC ..... 102/502
See application file for complete search history.

(56) References Cited

U.S. PATENT DOCUMENTS 5,898,125 A * 4/1999 Mangolds ..... F41H 13/0031 102/504
6,904,838 B1 * 6/2005 Dindl ..... B64D 45/0048 42/106
7,900,548 B2 * 3/2011 Hoadley ..... F41H 13/0006 89/902
8,141,493 B1 * 3/2012 Kuchman ..... F42B 12/66 102/501
8,387,540 B2 * 3/2013 Merems ..... F42B 12/56 102/501
2007/0026154 A1 2/2007 Chang et al.
2007/0261542 A1 * 11/2007 Chang ..... F41H 11/02 89/1.11
2012/0210904 A1 * 8/2012 Merems ..... F42B 12/56 102/504
2014/0216290 A1 * 8/2014 Yee ..... F41H 13/0006 102/374
2015/0168107 A1 * 6/2015 Tseng ..... F41B 11/00 124/56

FOREIGN PATENT DOCUMENTS

EP 0860683 A2 8/1998
EP 3623742 A1 3/2020

OTHER PUBLICATIONS

GB Office Action for GB application No. 2114048.8, dated Mar. 16, 2022, 7 pages.
International Search Report and Written Opinion for International application No. PCT/GB2022/052488, dated Feb. 16, 2023, 18 pages.

* cited by examiner

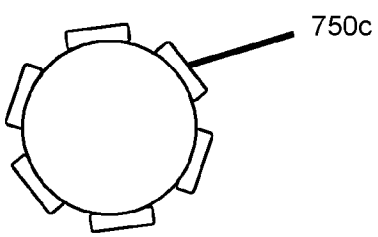
Figure 7a
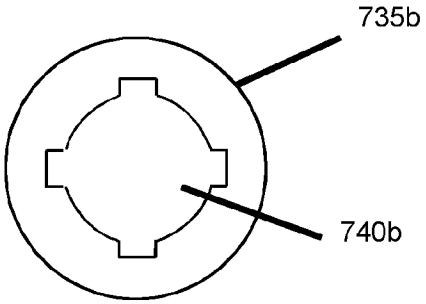
Figure 7b
Figure 7c
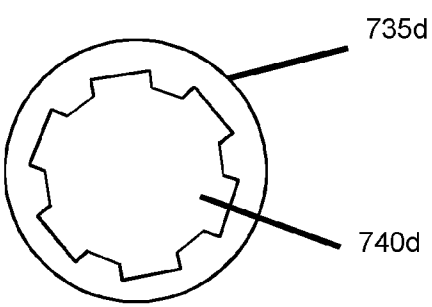
Figure 7d
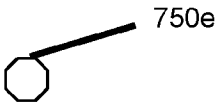
Figure 7e
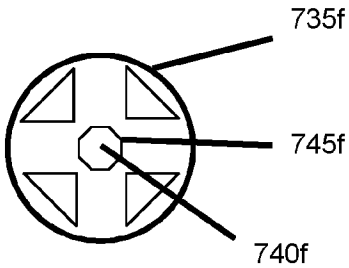
Figure 7f

NET-LAUNCHING SYSTEM

CROSS-REFERENCE TO RELATED APPLICATIONS

This application is a U.S. National Stage Application filed under 35 U.S.C. § 371 of PCT/GB2022/052488, filed Sep. 30, 2022, and entitled "NET-LAUNCHING SYSTEM", which claims priority from Great Britain Patent Application No. 2114048.8, filed on Sep. 30, 2021. The entire contents of each of the above-identified patent applications are incorporated herein by reference.

FIELD

The present disclosure relates to assemblies for use as net-launching projectiles. The disclosure also relates to systems for launching such projectiles to capture, disable, or immobilise an aerial target, and to methods of capturing an aerial target.

BACKGROUND

The recent rapid growth and development of the Unmanned Aerial Vehicle (UAV) and Unmanned Aircraft System (UAS) industry has resulted in an increased prevalence of small and/or inexpensive aerial vehicles which may require minimal levels of expertise to commission and operate. UAVs may be known in the art as 'drones'. Such UAVs may potentially pose a threat to public safety and privacy, and may be used to enter restricted areas or may be employed for malicious or illegal purposes.

It may be desirable to prevent effective use of UAVs in certain situations. In some circumstances it may prove relatively difficult to detect and track down a UAV operator, so several indirect and direct countermeasure methods have been developed to capture, disable, or immobilise UAVs during operation to prevent or inhibit their activities and/or remove any potential threat that such UAVs may pose.

Known direct countermeasures may include destruction, as well as capture by launching, or carrying, of nets to intercept an aerial target. However, such direct countermeasures may incur an unacceptable additional risk to public safety, especially where any propellant or firearm is involved. Indirect countermeasures such as radio-blocking or control techniques may be heavily regulated, and may often require expensive equipment. Furthermore, such indirect countermeasures may have limited success.

Current net-based countermeasures are typically complex, heavy and expensive systems with a limited range. Furthermore, existing systems often take a prohibitively long time to reload and the projectiles are often not reusable, or require elements to be recharged or replaced between uses.

It is therefore desirable to have a safe, easy to use system for launching a projectile to capture, disable, and/or immobilise an aerial target. It is desirable that the projectile is compact, inexpensive, simple, and with a low regulatory burden for its use in public spaces.

It is an object of at least one embodiment of at least one aspect of the present disclosure to obviate or at least mitigate at least one of the above identified problems, disadvantages and/or shortcomings of the prior art.

SUMMARY

According to a first aspect of the disclosure, there is provided an assembly for use as a net-launching projectile, the assembly comprising: a housing storing a net in a packed configuration and configured such that a rotation of the assembly causes the net to be ejected from the housing, thereby unpacking the net into an expanded configuration; and a plurality of circumferentially disposed protrusions or ridges for engaging with corresponding rifling in a barrel to induce the rotation of the assembly when launched.

Advantageously, rotating the projectile minimises the adverse effects of mass and configurational asymmetries which may result non uniform packaging of the net, material imperfections, manufacturing tolerances, and/or the like using the gyroscopic forces of the spin. This promotes flight stability, which may result in an increased accuracy, predictability, and repeatability between successive launches.

Advantageously, instead of requiring a plurality of barrels, using an induced rotation of the assembly to unpack the net enables the net-launching projectile to be packed into a relatively small and light-weight single housing which requires only a single barrel to launch.

Advantageously, the use of a single housing allows the housing to be designed with increased aerodynamic properties, thereby allowing increased firing speed, range, accuracy, control and/or the like.

The housing may comprise an elongate shaft for engaging with the barrel. The shaft may define a longitudinal axis. The plurality of protrusions or ridges may extend at least partly around the longitudinal axis. The at least one protrusion or ridge may be substantially helical. The shaft may be substantially polygonal, rounded-corner polygonal or Reuleaux polygonal in a cross-section orthogonal to the longitudinal axis.

Advantageously, the use of polygonal, or polygonal-like, shaft cross-sections reduces the degree of sharp edges which can be associated with accelerated wear and reduced serviceable life of the projectile and the barrel with which the projectile is configured to engage.

Advantageously, extending the disposed plurality of protrusions or ridges at least partly around the longitudinal axis improves the gas seal between the shaft and/or assembly, and the barrel with which the projectile is configured to engage. This enables a higher velocity launch when such a launch utilises the compression of a gas, liquid or other suitable compressible propellant.

The assembly may comprise a plurality of weights connected to the net. The plurality of weights may be configured such that a rotation of the assembly causes the plurality of weights to be ejected from the housing, thereby unpacking the net into an expanded configuration.

Advantageously, attaching weights to the net may encourage the net to be ejected from the projectile housing in a uniform and even manner, thereby expediently and efficiently unpacking the net into the expanded configuration.

Each weight of the plurality of weights may protrude from the housing when the net is in the packed configuration to provide the plurality of circumferentially disposed protrusions or ridges.

Advantageously, utilising the weights attached to the net to engage with the barrel to induce rotation of the barrel reduces the complexity of the projectile design, and size, weight and/or cost of the projectile manufacture reducing the number of separate parts required.

The housing may comprise a plurality of guides. Each weight may be disposed on a corresponding guide when the net is in the packed configuration. The plurality of weights may be configured to be ejected along the guides and from the housing by a rotation of the assembly, thereby unpacking the net into an expanded configuration.

Advantageously, the use of guides to hold the weights in a known position prior to ejection of the weights maintains the projectile mass distribution throughout a pre-ejection phase, thereby increasing stability, predictability and repeatability of the projectile behaviour.

Advantageously, the use of guides to direct the weights during their ejection from the projectile housing, allows the net to be expanded in a relatively repeatable and predictable manner. Additionally, the guides may be directed to minimise the likelihood of the weights and/or net becoming entangled during the ejection/expansion phase.

The assembly may comprise a release mechanism. The release mechanism may be configured to controllably release the plurality of weights from the housing.

Advantageously, the use of a controllable release mechanism enables the weights to be ejected, and subsequently the net to be unpacked into the expanded configuration, at a specifiable time and/or distance from the launch and/or target position. The projectile assembly may exhibit increased aerodynamic properties in the packed configuration, thereby maintaining this packed configuration for a period of time subsequent to launch may increase the potential range, speed and/or accuracy of the projectile assembly.

The release mechanism may comprise at least one electromagnet configured to control release of the plurality of weights from the housing.

Advantageously, this provides a simple, lightweight method of delaying the ejection of the weights, allowing the weights to be ejected substantially simultaneously without requiring any complex mechanism or the like.

The release mechanism may comprise a timer for delaying a release of the plurality of weights from the housing.

Advantageously, by using a timer which may be fixed, or programmable during, after, or before launch of the projectile, the range and/or accuracy of the projectile can be optimised. For example, a release time of the timer may be extended or shortened in response to a change in local wind speed or direction affecting the predicted launch velocity.

The release mechanism may comprise an actuator configured to release the plurality of weights under remote control.

The actuator may comprise a latch, valve or other mechanical device which may allow ejection of the weights in response to a remote control signal. The remote control signal may be sent through infrared light, visible light, radio waves, soundwaves or any other suitable remote communication method.

The release mechanism may comprise a collar configurable to release the plurality of weights.

Advantageously, the use of a collar e.g. a circular collar whereby the weights can be radially distributed around such a collar may simplify the substantially simultaneously ejection of the weights by providing a method of releasing the plurality of weights using a single mechanical action.

The release mechanism may comprise a squib configured to release and/or expel the plurality of weights from the housing.

A squib may enable radial, or radial like, acceleration of the weights during ejection reducing the time required to unpack the net into its expanded configuration. Beneficially, this may allow the assembly to remain in a more aerodynamic packed configuration for a longer period of time following launch, thereby extending the potential range, stability, velocity and the like of the projectile assembly.

The release mechanism may comprise a beneficial combination of the above-described features and methods and control of such features and methods. For example, an actuation of an electromagnet and/or a squib and/or a collar may be controlled by a timer and/or remotely. The release mechanism may be actuated, for example, in response to a user initiated control or a pre-determined criteria based on feedback from sensors located on and/or in the projectile.

Rotation of the assembly may cause each weight of the plurality of weights to be ejected from the housing in a different direction.

Advantageously, as the plurality of weights is connected to the net, the ejection of each of the plurality of the weights in a different direction facilitates a timeous unpacking of the net into the expanded configuration.

Rotation of the assembly may cause the plurality of weights to be ejected from the housing by centrifugal forces acting upon each of the plurality of weights.

Advantageously, utilising the centrifugal forces imparted on the weights by the induced rotation of the projectile assembly during launch to eject the weights from the housing may negate the requirement for the assembly to comprise any additional mechanism for propelling the weights from the housing.

A total weight of the plurality of weights may be greater than a weight of the net.

Advantageously, this ensures that following unpacking, the net remains in the expanded configuration, and remains stable in flight, when the weights are predominantly distributed around the periphery of the net.

Each weight of the plurality of weights may have a same mass as each other weight of the plurality of weights.

Advantageously, this provides an even distribution of the weights before, after, and during the unpacking of the net into the expanded configuration. This improves stability and accuracy of the assembly following launch.

The plurality of weights may comprise at least four weights.

Advantageously, the use of four weights allows the required net area to be optimised against the additional size, weight, complexity and the like of additional weights.

At least one of the plurality of weights may be magnetic.

At least one of the plurality of weights may be metallic.

Advantageously having at least one magnetic weight, and at least one weight metallic (e.g. comprised of a ferrous metal) may result in one or more magnetic connections to be made and maintained between one or more weights following contact of the net with a target, thereby ensnaring the target (e.g. a UAV, UAS or other airborne target) in the net and/or attaching the magnetic weight to metallic elements of the target.

Advantageously, a metallic weight may generally have a higher density than a non-metallic weight allowing a greater mass and/or a smaller weight to be utilised for a given volume in the projectile assembly without requiring excessively expensive materials to be used An outer surface of the housing may be substantially circular in a cross-section parallel to a plane defined by the plurality of weights.

Advantageously, using a housing with a substantially circular cross-section with a substantially uniform radius may maximise an engagement of the protrusions or ridges with the corresponding rifling in a barrel. This may optimise an induced rotation achievable during launch of the projectile.

The plurality of weights may be evenly distributed around a centre of the assembly when the net is in the packed configuration.

Advantageously, this may provide an even distribution of the weights before unpacking of the net into the expanded configuration. This may improve stability and accuracy of the assembly following launch.

The housing may be attached to the net.

Advantageously, the net being attached to the housing maintains the mass of the projectile following the unpacking of the net into the expanded configuration. This may assist the predictability of the flight path of the projectile following unpacking of the net and prevent the discarded housing from adversely affecting said flight path.

In addition, the impact of the housing and net on the target may disrupt the target more significantly than impact from the net alone.

The housing may be attached to a centre of the net.

Advantageously, this may ensure the net unpacks evenly and uniformly without inciting any significant deviation in the projectiles intended flight path.

A first portion of the housing may be provided on a first side of the net. A second portion of the housing may be provided on a second side of the net.

Advantageously, this may allow a relatively un-aerodynamic net to be fully enclosed by the relatively aerodynamic housing in its packed configuration which may result in an increased firing speed, range, accuracy, control and/or the like.

The first portion of the housing and the second portion of the housing may be coupleable.

The first portion of the housing and the second portion of the housing may comprise a coupling for coupling the first portion of the housing to the second portion of the housing. Such a coupling may comprise any of: a push fit, screw fit, friction fit, or magnetic coupling and/or the like. Such a coupling may beneficially allow the projectile assembly to be, for example, rapidly, simply, and repeatedly assembled and disassembled to manufacture, transport and/or repack the net into the housing.

According to a second aspect of the disclosure, there is provided an assembly for use as a net-launching projectile. The assembly comprises: a plurality of weights connected to a net, and a housing storing the net in a packed configuration. The housing comprises a plurality of guides. Each weight is disposed on a corresponding guide when the net is in the packed configuration. The plurality of weights are configured to be ejected along the guides and from the housing by a rotation of the assembly, thereby unpacking the net into an expanded configuration.

Advantageously, the use of guides to hold the weights in a known position prior to ejection of the weights maintains the projectile mass distribution throughout the pre-ejection phase increasing stability, predictability and repeatability of the projectile behaviour.

Advantageously, the use of guides to direct the weights during their ejection from the projectile housing, may allow the net to be expanded in a relatively repeatable and predictable manner. Additionally, the guides may be directed to minimise the likelihood of the weights and/or net becoming entangled during the ejection/expansion phase.

Advantageously, rotating the projectile may minimise any adverse effects of mass and configurational asymmetries due to a non-uniform packaging of the net, material imperfections, manufacturing tolerances, and/or the like. This may promote flight stability, which may result in an increased accuracy, predictability, and/or repeatability between successive launches.

Advantageously, instead of requiring a plurality of barrels, using an induced rotation of the assembly to unpack the net enables the net-launching projectile to be packed into a relatively small single housing, which requires a single barrel to launch.

Advantageously, the use of a single housing allows the housing to be designed with increased aerodynamic properties allowing increased firing speed, range, accuracy, control and/or the like.

Each guide may comprise and/or define a channel extending from an opening in the housing.

Each channel may extend towards a centre of the assembly.

That is each channel may extend from the outer surface of the housing substantially towards the centre of the housing. Each channel may not extend beyond the outer surface.

Advantageously, this maintains the aerodynamic properties of the housing.

Each channel may extend along a respective axis parallel to a radial path extending towards a centre of the assembly.

That is, each channel may be disposed on a path substantially parallel to, but offset in angle and position from, a radial path from the outer surface of the housing towards the centre of the housing.

Each guide may be configured to guide each weight to be ejected from the housing in a substantially radial direction Each guide may be configured to guide each weight to be ejected from the housing in a direction parallel to a radial direction.

Each guide may be configured to guide each weight to be ejected from the housing in a direction between tangential and normal to an/the outer surface of the housing.

Advantageously, this may allow the ejection path of the weights to be optimised to, for example, minimise opportunity for incomplete unpacking of the net, and maximise the efficient and timeous unpacking of the net, into the expanded configuration.

The assembly may comprise a release mechanism configured to controllably release the plurality of weights from the housing.

The release mechanism may comprise at least one electromagnet configured to control release of the plurality of weights from the housing.

The release mechanism may comprise a timer for delaying a release of the plurality of weights from the housing.

The release mechanism may comprise an actuator configured to release the plurality of weights under remote control.

The release mechanism may comprise a collar configurable to release the plurality of weights.

The release mechanism may comprise a squib configured to release and/or expel the plurality of weights from the housing.

Rotation of the assembly may cause each weight of the plurality of weights to be ejected from the housing in a different direction.

Rotation of the assembly may cause the plurality of weights to be ejected from the housing by centrifugal forces acting upon each of the plurality of weights.

A total weight of the plurality of weights may be greater than a weight of the net.

Each weight of the plurality of weights may have a same mass as each other weight of the plurality of weights.

The plurality of weights may comprise at least four weights.

At least one of the plurality of weights may be magnetic.

At least one of the plurality of weights may be metallic.

An outer surface of the housing may be substantially circular in a cross-section parallel to a plane defined by the plurality of weights.

The plurality of weights may be evenly distributed around a centre of the assembly when the net is in the packed configuration.

The housing may be attached to the net.

The housing may be attached to a centre of the net.

A first portion of the housing may be provided on a first side of the net. A second portion of the housing may be provided on a second side of the net.

The first portion of the housing and the second portion of the housing may be coupleable.

According to a third aspect of the disclosure, there is provided an assembly for use as a net-launching projectile, the assembly comprising: a plurality of weights connected to a net, a housing storing the net in a packed configuration, and a release mechanism configured to controllably release the plurality of weights from the housing.

Advantageously, the use of a controllable release mechanism may enable the weights to be ejected, and subsequently the net to be unpacked into the expanded configuration, at a specifiable time and/or distance from the launch and/or target position. The projectile assembly may exhibit increased aerodynamic properties in the packed configuration and therefore maintaining this packed configuration for a period of time subsequent to launch may increase a potential range, speed and/or accuracy of the projectile assembly.

Following a release of the plurality of weights from the housing by the release mechanism, the plurality of weights may be configured to be ejected from the housing by a rotation of the assembly, thereby unpacking the net into an expanded configuration.

The release mechanism may comprise at least one electromagnet configured to control release of the plurality of weights from the housing.

The release mechanism may comprise a timer for delaying a release of the plurality of weights from the housing.

The release mechanism may comprise an actuator configured to release the plurality of weights under remote control.

The release mechanism may comprise a collar configurable to release the plurality of weights.

The release mechanism may comprise a squib configured to release and/or expel the plurality of weights from the housing.

Rotation of the assembly may cause each weight of the plurality of weights to be ejected from the housing in a different direction.

Rotation of the assembly may cause the plurality of weights to be ejected from the housing by centrifugal forces acting upon each of the plurality of weights.

A total weight of the plurality of weights may be greater than a weight of the net.

Each weight of the plurality of weights may have a same mass as each other weight of the plurality of weights.

The plurality of weights may comprise at least four weights.

At least one of the plurality of weights may be magnetic.

At least one of the plurality of weights may be metallic.

An outer surface of the housing may be substantially circular in a cross-section parallel to a plane defined by the plurality of weights.

The plurality of weights may be evenly distributed around a centre of the assembly when the net is in the packed configuration.

The housing may be attached to the net. The housing may be attached to a centre of the net.

A first portion of the housing may be provided on a first side of the net.

A second portion of the housing may be provided on a second side of the net.

The first portion and the second portion may be coupleable.

According to a fourth aspect of the disclosure there is provided a net-launching system comprising: an assembly according to any preceding aspect, and a launcher configured to launch the assembly from a barrel, wherein the barrel is rifled to induce the rotation of the assembly when launched.

The barrel may be configured to engage with a/the plurality of circumferentially disposed protrusions or ridges on the assembly.

The barrel may be rifled with a plurality of channels or grooves for engaging with the plurality of circumferentially disposed protrusions or ridges on the assembly.

The barrel may be rifled to comprise a substantially polygonal, rounded-corner polygonal or Reuleaux polygonal opening in cross-section corresponding to a cross-sectional shape of the assembly.

Advantageously, the use of polygonal, or polygonal-like, barrel cross-sections may reduce a degree of sharp edges which can be associated with accelerated wear and reduced serviceable life of the barrel and the projectile with which the barrel is configured to engage.

Advantageously, extending the disposed plurality of protrusions or ridges at least partly around the longitudinal axis may improve a gas seal between the barrel and the projectile shaft and/or assembly with which the barrel is configured to engage. This enables a higher velocity launch when such a launch utilises the compression of a gas, liquid or other suitable compressible propellant.

Each protrusion or ridge of the plurality of protrusions or ridges may be at least a portion of one of the plurality of weights.

Advantageously, utilising the weights attached to the net to engage with the barrel to induce rotation of the barrel reduces the complexity of the projectile design, and size, weight and/or cost of the projectile manufacture reducing the number of separate parts required.

Each protrusion or ridge of the plurality of protrusions or ridges may be provided on an/the elongate shaft of the housing of the assembly.

The launcher may be configured to eject the assembly from the barrel using a pressurized gas and/or a propellant.

The net-launching system may comprise an Unmanned Aerial Vehicle (UAV). The launcher may be coupled to the UAV.

The UAV may be a fixed-wing UAV.

The UAV may be a rotary wing UAV, a jet powered UAV, a rocket powered UAV and/or the like.

Advantageously, coupling the launcher to a UAV, UAS, or other suitable airborne platform may facilitate minimising a distance between the intended airborne target and net-launching system, increasing the accuracy and effectiveness of the net-launching system.

The launcher may be coupled to the UAV by a fixed or gimballed fixture.

Advantageously, a fixed coupling may provide a relatively simpler, cheaper, lighter etc. design with few moving parts.

Advantageously, a gimballed fixture may facilitate aiming the launcher towards a target at a plurality of angles from the UAV without having to manually adjust the coupling angle.

According to a fifth aspect of the disclosure, there is provided a method of capturing an aerial target. The method comprises launching a projectile towards the aerial target from a launcher having a barrel rifled to induce a rotation of the projectile. The projectile comprises a plurality of weights connected to a net and a housing storing the net in a packed configuration and wherein the rotation of the projectile causes the plurality of weights to be ejected from the housing, thereby unpacking the net into an expanded configuration for capturing the aerial target.

The method may comprise launching the projectile from a launcher. The launcher may be coupled to a UAV.

The above summary is intended to be merely exemplary and non-limiting. The disclosure includes one or more corresponding aspects, embodiments or features in isolation or in various combinations whether or not specifically stated (including claimed) in that combination or in isolation. It should be understood that features defined above in accordance with any aspect of the present disclosure or below relating to any specific embodiment of the disclosure may be utilized, either alone or in combination with any other defined feature, in any other aspect or embodiment or to form a further aspect or embodiment of the disclosure.

BRIEF DESCRIPTION OF THE DRAWINGS

These and other aspects of the present disclosure will now be described, by way of example only, with reference to the accompanying drawings, wherein:

FIG. 7*a* depicts a cross sectional view of the assembly for use as a net-launching projectile of the net-launching system of FIG. 1;

FIG. 7*b* depicts a cross sectional view of the barrel of the net-launching system of FIG. 1;

FIG. 7*c* depicts a cross sectional view of the elongate shaft of the assembly for use as a net-launching projectile of the net-launching system of FIG. 2;

FIG. 7*d* depicts a cross sectional view of the inner barrel of the net-launching system of FIG. 2;

FIG. 7*e* depicts a cross sectional view of the elongate shaft of the assembly for use as a net-launching projectile of the net-launching system of FIG. 3;

FIG. 7*f* depicts a cross sectional view of the barrel of the net-launching system of FIG. 3;

DETAILED DESCRIPTION OF THE DRAWINGS

Figure 1:
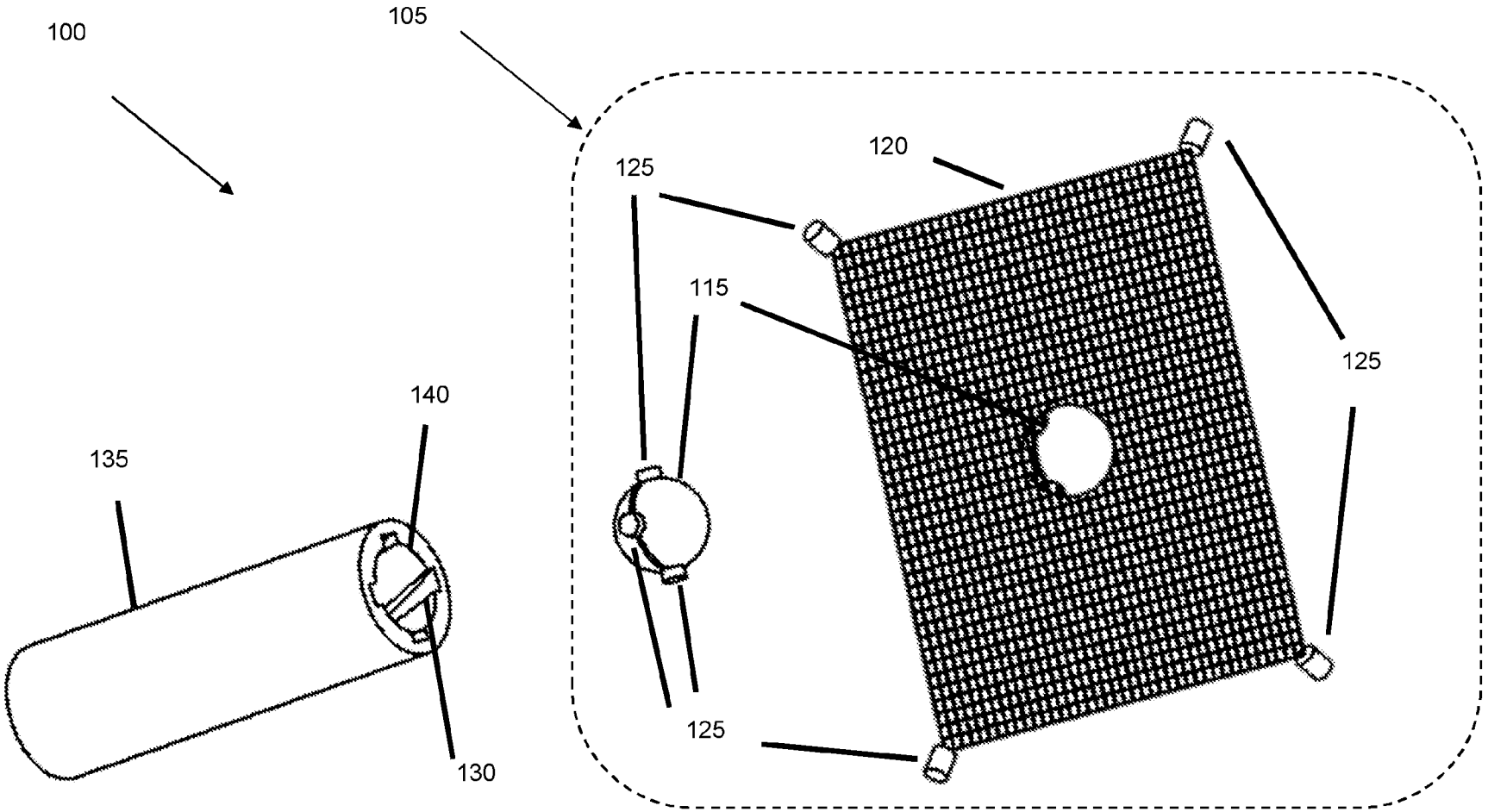
FIG. 1 depicts a perspective view of net-launching system showing an assembly for use as a net-launching projectile with a net in a packed and in an expanded configuration, according to an embodiment of the disclosure.

FIG. 1 depicts a perspective view of net-launching system 100 showing an assembly 105 for use as a net-launching projectile having a net in a packed and in an expanded configuration, according to an embodiment of the disclosure. References to the net in the expanded configuration are also herein referred to as an 'unpacked' configuration.

The assembly 105 comprises a housing 115 having a substantially circular cross-section and storing a net 120 in a packed configuration and configured such that a rotation of the assembly 105 causes the net 120 to be ejected from the housing 115, thereby unpacking the net 120 into an expanded configuration. In the example embodiment of FIG. 1, the housing 115 comprises a first portion on a first side of the net 120 and a second portion on a second side of the net 120. The first and second portion of the housing 115 are coupleable to facilitate, at least, the attachment of the housing 115 to the centre of the net 120. The coupling may be a push fit, screw fit, friction fit, or magnetic coupling and/or the like.

The assembly 105 also comprises a plurality of circumferentially disposed protrusions 125 configured for engagement with corresponding rifling 130 in a barrel 135 to induce the rotation of the assembly 105 when launched from the barrel 135.

In the embodiment of FIG. 1, the plurality of circumferentially disposed protrusions 125 consist of four weights evenly distributed around the centre of the assembly 105 when the net 120 is in the packed configuration. In the depicted example, a distal end of the weights relative to a centre of the assembly is relatively flat-ended. As described below, in other embodiments the protrusions 125 may be ridges which may be helical, and the distal end of the weights may be domed and/or flush to the outer surface of the housing 115. Although this embodiment uses four weights, which have been found to give the optimal balance between the weight of the assembly 105 and the area of the expanded net 120, other embodiments may use more than four weights.

The four weights 125 are connected to the net 120 and configured such that a rotation of the assembly 105 causes the weights 125 attached to the net 120 to be ejected from the housing 115 in different directions by centrifugal forces acting upon each of the plurality of weights 125, encouraging the net 120 to be ejected from the housing 115 and unpacked into an expanded configuration in an even and uniform manner.

The net-launching system further comprises a barrel 135 comprising rifling 130 configured to engage with the circumferentially disposed protrusions 125 of the assembly 105 when in the packed configuration inducing a rotation of the assembly 105 during its launch. The example rifling 130 comprises channels, although as described below in other embodiments the rifling may comprise grooves.

The barrel 135 further comprises an opening 140 in cross-section corresponding to a cross-sectional shape of the assembly 105 when in the packed configuration. As described below, in further embodiments the barrel 135 may comprise a substantially polygonal, rounded-corner polygonal or Reuleaux polygonal opening.

Figure 2:
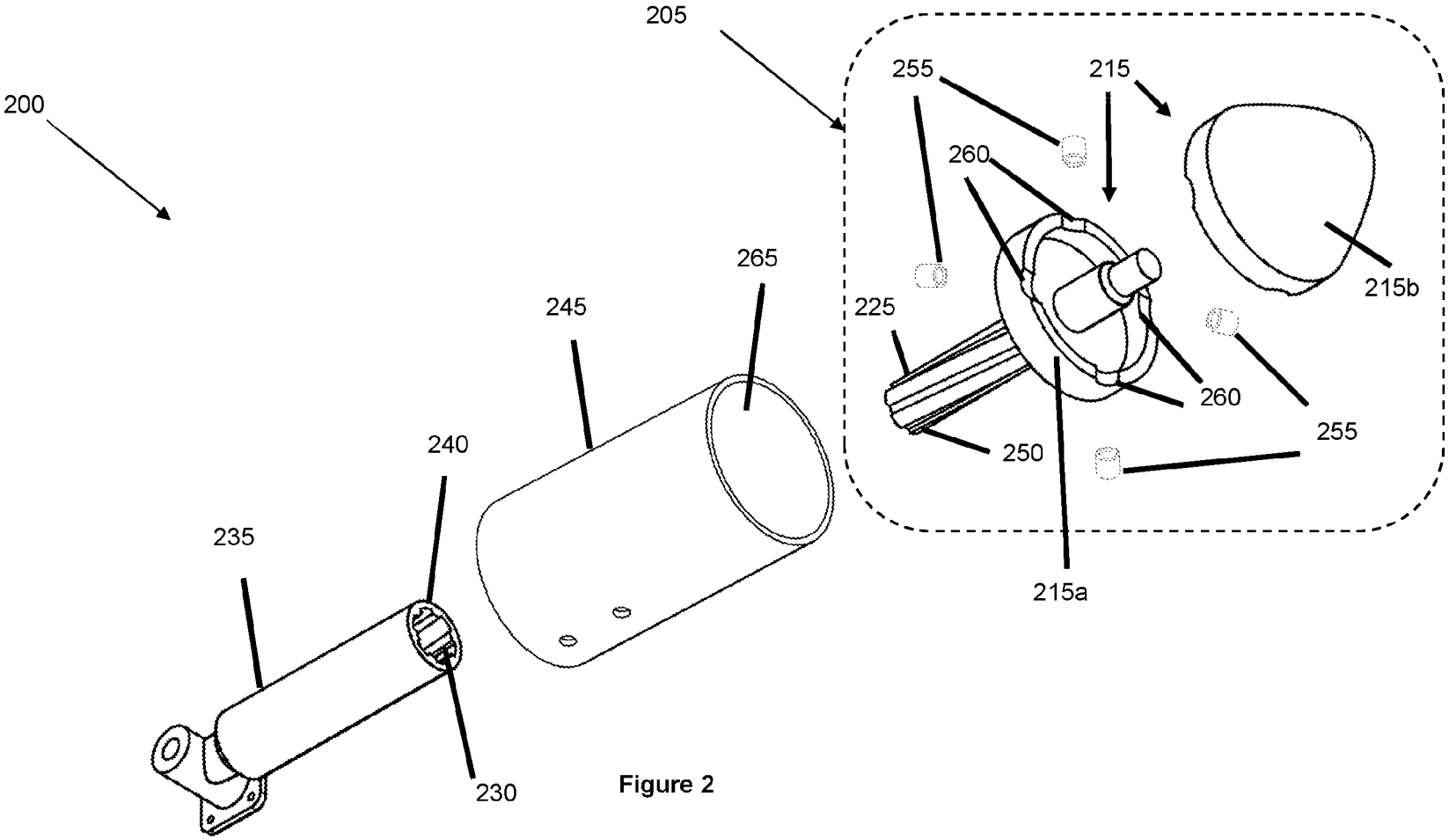
FIG. 2 depicts an exploded view of a net-launching system according to a further embodiment of the disclosure.

FIG. 2 depicts an exploded view of a net-launching system according to a further embodiment of the disclosure, which generally corresponds to FIG. 1. For the purposes of clarity and brevity the net 120 and its expanded (also the unpacked) configuration is not shown. However, it should be understood that the housing 215 of FIG. 2 is configured such that a rotation of the assembly 205 causes a net to be ejected from the housing 215, thereby unpacking the net into an expanded configuration.

The housing 215 comprises a first portion 215*a* and a second portion 215*b*. The first and second portion of the housing 215*a* and 215*b* are coupleable to facilitate, at least, the attachment of the housing 215 to the centre of the net. The coupling is a push fit but in other embodiments may be a screw fit, friction fit, or magnetic coupling and/or the like.

The weights 255 of FIG. 2 consist of four weights which are flush to the outer surface of the housing 215. When the housing 215 is in the packed configuration each weight 255 of the plurality weights is located in one of a plurality of guides 260. In this embodiment the guides 260 do not extend beyond an inner surface of the housing 215 although, as described below, in further embodiments the guides 260 may comprise channels extending towards the centre of the housing 215.

The weights 255 are attached to the net corresponding to the attachment of the weights 125 to the net 120 of FIG. 1.

The assembly 205 comprises an elongate shaft 250 for engaging with a barrel, which in the example of FIG. 2 is depicted as an inner barrel 240. The inner barrel 240 defines a longitudinal axis. The assembly 205 further comprises a plurality of protrusions 225 extending helically around the longitudinal axis of the elongate shaft 250 for engaging with the rifling 230 of the inner barrel 240.

The example net-launching system 200 further comprises an outer barrel 245 comprising an opening 265 in cross-section corresponding to a cross-sectional shape of the assembly 205 when in the packed configuration. It will be appreciated that, in other embodiments falling within the scope of the disclosure, and outer barrel may not be present.

As described above, the net-launching system 200 comprises an inner barrel 235 comprising rifling 230 configured to engage with the circumferentially disposed protrusions 225 of the shaft 250, thereby configured to induce a rotation of the assembly 205 during its launch. The rifling 230 comprises channels. As described below in further embodiments, the rifling may comprise grooves.

The inner barrel 235 further comprises an opening 240 in cross-section corresponding to a cross-sectional shape of the shaft 250. As described below in further embodiments the inner barrel 235 comprises a substantially polygonal, rounded-corner polygonal or Reuleaux polygonal opening.

In this embodiment the inner barrel 235 and outer barrel 245 are separable. As described below in further embodiments the inner barrel 235 and outer barrel 245 are comprised of a single combined barrel element.

Figure 3:
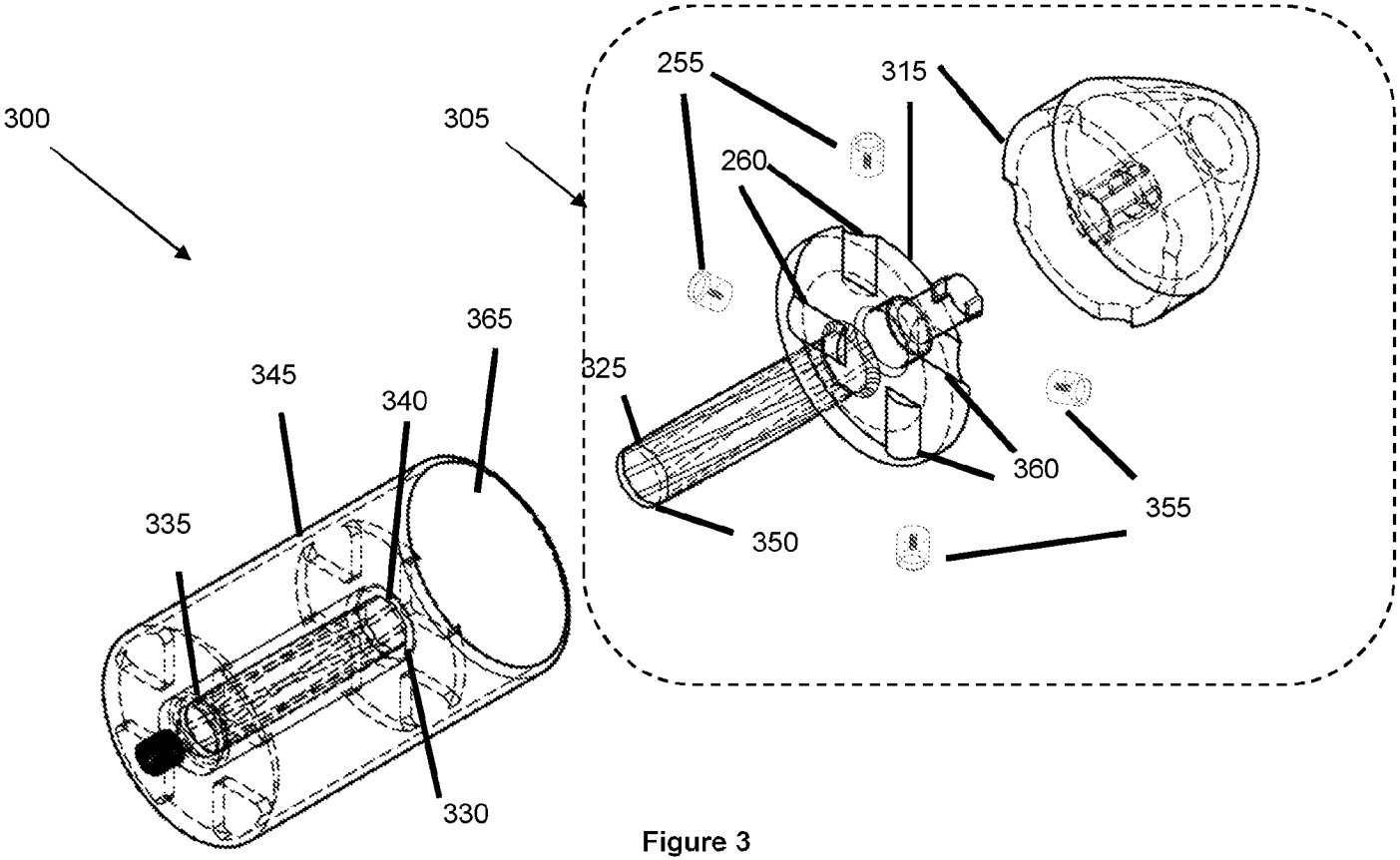
FIG. 3 depicts an exploded view of net-launching system according to a further embodiment of the disclosure.

FIG. 3 generally corresponds to FIG. 2, in that it depicts an exploded view of a net-launching system 300 according to a further embodiment of the disclosure. However, in FIG. 3, when the housing 315 is in the packed configuration each weight 355 of the plurality weights is located in one of a plurality of guides. In the embodiment of FIG. 3, the plurality of guides comprise channels extending from the outer surface of the housing 315 towards the centre of the housing 315. The channels 360 extend along a respective axis parallel to a radial path extending towards a centre of the housing 315 configured to guide each weight to be ejected from the housing 315 in a direction parallel to a radial direction, although it is understood that in further embodiments the respective axis may be disposed on a path substantially parallel to, but offset in angle and position from, a radial path.

Furthermore, the assembly 305 comprises an elongate shaft 350 for engaging with the inner barrel 340. The elongate shaft 350 defines a longitudinal axis. The assembly 305 further comprises a plurality of ridges 325 extending helically around the longitudinal axis of the elongate shaft 350 for engaging with the rifling 330 of the inner barrel 340. The rifling 330 comprises grooves.

The inner barrel 335 further comprises a substantially polygonal opening 340 in cross-section corresponding to a cross-sectional shape of the shaft 350. The inner barrel 335 and outer barrel 345 of FIG. 3 are comprised of a single barrel element.

Figure 4B:
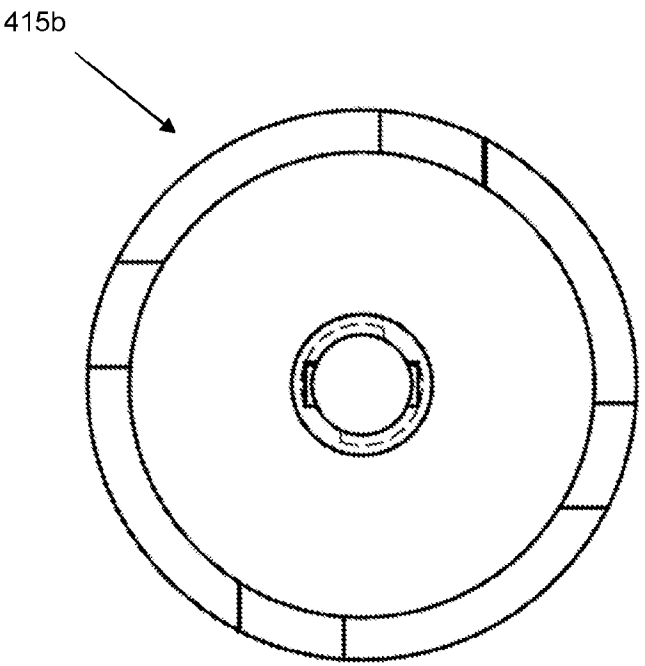
FIG. 4*b* depicts a cross sectional view of a second portion of an assembly for use as a net-launching projectile, according to an embodiment of the disclosure, coupleable to the first portion of FIG. 4*a;*
Figure 4A:
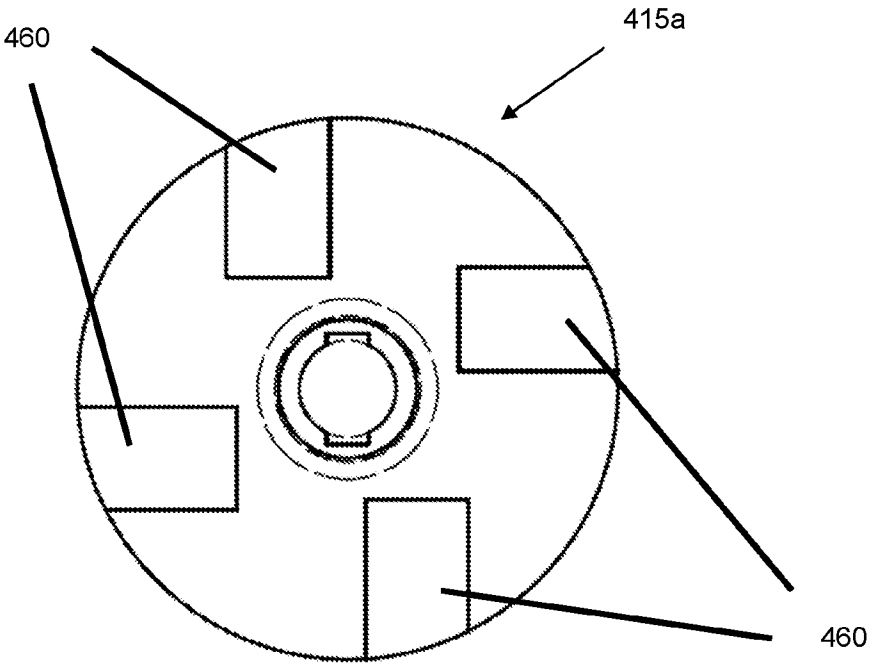
FIG. 4*a* depicts a cross sectional view of a first portion of an assembly for use as a net-launching projectile, according to an embodiment of the disclosure

FIG. 4*a* and FIG. 4*b* depict a cross sectional view of a first portion 415*a* and second portion 415*b* of a housing of an assembly for use as a net-launching projectile, according to an embodiment of the disclosure. Such a housing may, for example, correspond to the housing of the assemblies 105, 205, 305 of any of FIGS. 1 to 3, or any other suitable housing.

The first portion 415*a* comprises a plurality of guides 460. The guides 460 comprise channels extending from the outer surface of the first portion 415*a* towards the centre of the first portion 415*a*. The channels 460 extend along a respective axis parallel to a radial path extending towards a centre of the first portion 415*a*. As such, the channels 460 are configured to guide each weight to be ejected from the housing of any of FIGS. 1 to 3 in a direction parallel to a radial direction, although it is understood that in further embodiments the respective axis may be disposed on a path substantially parallel to, but offset in angle and position from, a radial path.

The first portion 415*a* and second portion 415*b* of the housing are coupleable to facilitate, at least, the attachment of the housing to the net, e.g. a centre of the net. The coupling may be a push fit, screw fit, friction fit, or magnetic coupling and/or the like.

Figure 5B:
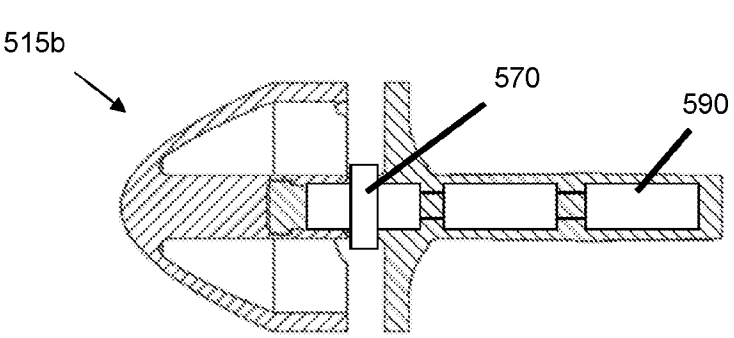
FIG. 5*b* depicts a cross sectional view of a housing from an assembly for use as a net-launching projectile comprising a release mechanism comprising a collar, according to an embodiment of the disclosure
Figure 5D:
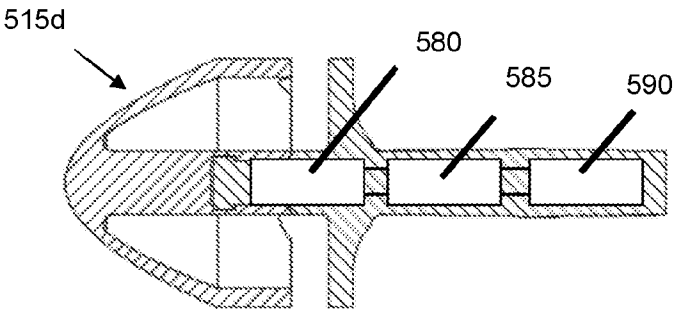
FIG. 5*d* depicts a cross sectional view of a housing from an assembly for use as a net-launching projectile comprising a release mechanism comprising an actuator and timer, according to an embodiment of the disclosure
Figure 5A:
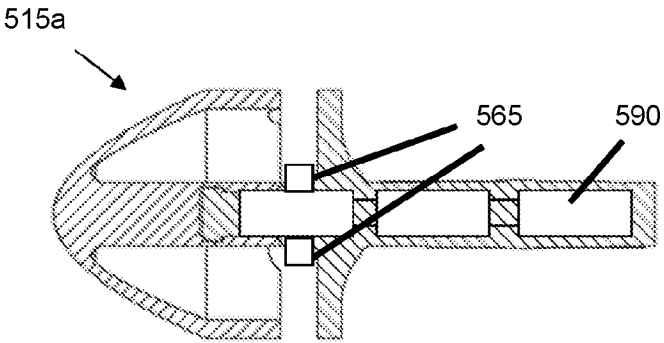
FIG. 5*a* depicts a cross sectional view of a housing from an assembly for use as a net-launching projectile comprising a release mechanism comprising a plurality of electromagnets, according to an embodiment of the disclosure

FIG. 5*a* depicts a cross sectional view of a housing 515*a* from an assembly for use as a net-launching projectile comprising a release mechanism comprising a plurality of electromagnets 565, according to an embodiment of the disclosure.

In an example embodiment, the electromagnets 565 are powered by a power source 590 and controlled remotely, whereby removing power to the electromagnets 565 releases the weights from the housing 515*a*. Each electromagnet is configured to release one weight although in further embodiments a single electromagnet is configured to release a plurality of weights. As described below, in further embodiments the electromagnetic control may be facilitated using a timer. The power source 590 may be, for example, a charge storage device such as a capacitor.

FIG. 5*b* depicts a cross sectional view of a housing 515*b* from an assembly for use as a net-launching projectile comprising a release mechanism comprising a collar 570, according to an embodiment of the disclosure.

The movement of the collar 570, e.g. in a direction parallel to an axis defined by the shaft, may be powered by the power source 590 and/or controlled remotely, whereby applying power to the collar may simultaneously releases all of the plurality of weights from the housing 515*b*. In further embodiments, removal of the power source, or a depletion or reduction in a supplied power, may release the collar 570, simultaneously releasing all of the plurality of weights from the housing 515*b*.

Figure 5C:
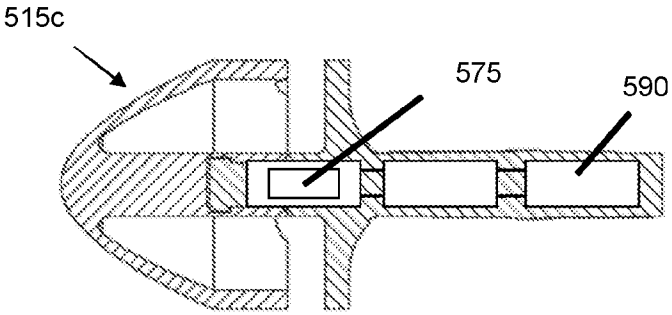
FIG. 5*c* depicts a cross sectional view of a housing from an assembly for use as a net-launching projectile comprising a release mechanism comprising a squib, according to an embodiment of the disclosure

FIG. 5*c* depicts a cross sectional view of a housing 515*c* from an assembly for use as a net-launching projectile, comprising a release mechanism comprising a squib 575, according to an embodiment of the disclosure.

Triggering of the squib 575 may be facilitated using the power source 590 and/or controlled remotely, whereby the squib 575 when triggered, e.g. detonated, may exert a force on the weights, forcibly ejecting the weights from the housing 515*c*. In further embodiments, a plurality of squibs may be used and in yet further embodiments the/each squib may be used to forcibly release a mechanism holding the weights within the housing 515*c*, e.g. a collar 570.

FIG. 5*d* depicts a cross sectional view of a housing 515*d* from an assembly for use as a net-launching projectile comprising a release mechanism comprising an actuator 580 and timer 585, according to an embodiment of the disclosure. The actuator 580 and timer 585 are powered by the power source 590 and when the timer 585 down to a set value e.g. zero, the actuator 580 releases the weights from the housing 515*d*. In further embodiments the timer is a mechanical timer and/or the weights are released when the timer counts up to a set value.

Figure 6:
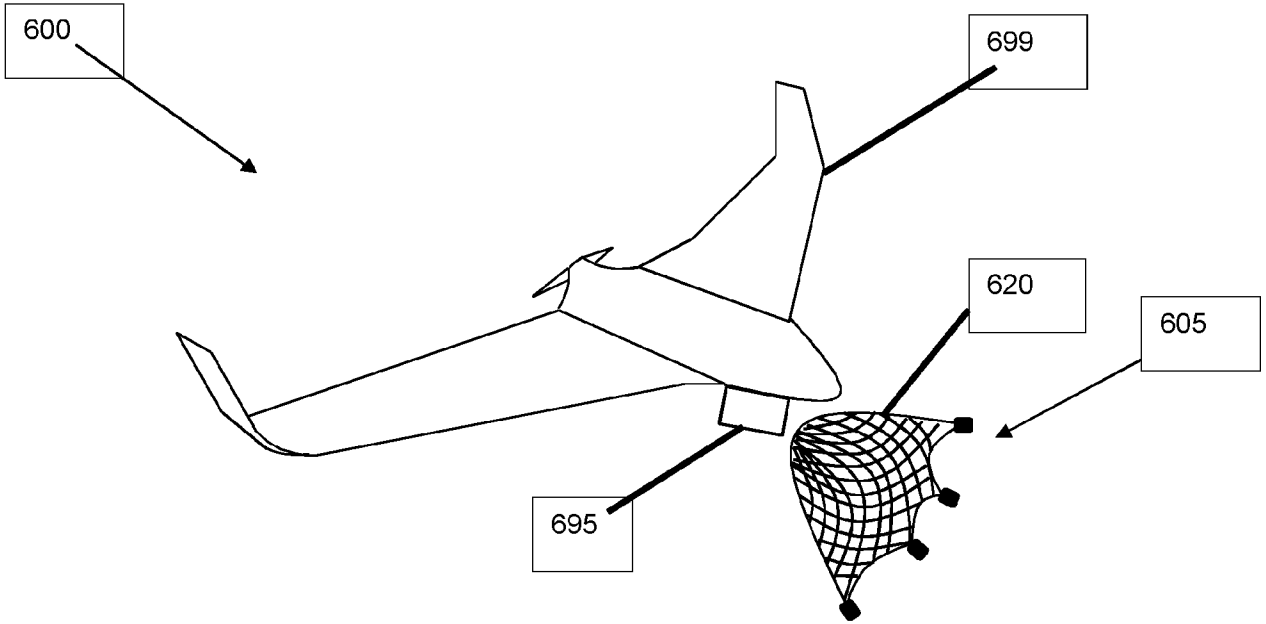
FIG. 6 depicts a net-launching system comprising a launcher coupled to a UAV showing an assembly for use as a net-launching projectile in an expanded configuration

FIG. 6 depicts a net-launching system 600 comprising a launcher 695 coupled to a UAV 699 showing an assembly for use as a net-launching projectile 605 in an expanded configuration.

IN an example use-case, the UAV 699 may follow or generally approach the intended target until it is within a suitable range. The UAV may launched the assembly for use as a net-launching projectile 605 from the launcher 695 such that a rotation of the assembly 605 causes a net 620 to be ejected from the assembly 605, thereby unpacking the net 620 into an expanded configuration.

In the example of FIG. 6, the launcher is coupled to the UAV by a fixed fixture. However, in further embodiments the launcher may be coupled to the UAV by a configurable fixture, such as a gimballed fixture. The UAV is a fixed wing UAV, however in further embodiments the UAV may be a rotary wing, jet powered, or rocket powered UAV.

FIG. 7*a* depicts a cross sectional view of the assembly 705*a* for use as a net-launching projectile of the net-launching system 100 of FIG. 1;

FIG. 7*b* depicts a cross sectional view of the barrel 735*b* of the net-launching system 100 of FIG. 1;

The barrel 735*b* comprises an opening 740*b* in cross-section corresponding to a cross-sectional shape of the assembly 705*a* when in the packed configuration.

FIG. 7*c* depicts a cross sectional view of the elongate shaft 750*c* of the assembly for use as a net-launching projectile of the net-launching system 200 of FIG. 2;

FIG. 7*d* depicts a cross sectional view of the inner barrel 735*d* of the net-launching system 200 of FIG. 2;

FIG. 7*e* depicts a cross sectional view of the elongate shaft 750*e* of the assembly for use as a net-launching projectile of the net-launching system 300 of FIG. 3;

The inner barrel 735*d* further comprises an opening 740*d* in cross-section corresponding to a cross-sectional shape of the shaft 750*c*.

FIG. 7*f* depicts a cross sectional view of the combined inner barrel 735*f* and outer barrel 745*f* of the net-launching system 300 of FIG. 3.

The inner barrel 735*f* further comprises a substantially polygonal opening 740*f* in cross-section corresponding to a cross-sectional shape of the shaft 750*e*. Although the disclosure has been described in terms of preferred embodiments as set forth above, it should be understood that these embodiments are illustrative only and that the claims are not limited to those embodiments. Those skilled in the art will be able to make modifications and alternatives in view of the disclosure, which are contemplated as falling within the scope of the appended claims. Each feature disclosed or illustrated in the present specification may be incorporated in any embodiments, whether alone or in any appropriate combination with any other feature disclosed or illustrated herein.

The invention claimed is:

1. An assembly for use as a net-launching projectile, the assembly comprising:

a housing storing a net in a packed configuration and configured such that a rotation of the assembly causes the net to be ejected from the housing, thereby unpacking the net into an expanded configuration; and a plurality of circumferentially disposed protrusions or ridges for engaging with corresponding rifling in a barrel to induce the rotation of the assembly when launched.

2. The assembly of claim 1, wherein the housing comprises an elongate shaft for engaging with the barrel, the shaft defining a longitudinal axis, and wherein the plurality of protrusions or ridges extend at least partly around the longitudinal axis, and wherein the at least one protrusion or ridge is substantially helical, and wherein the shaft is substantially polygonal, rounded-corner polygonal or Reuleaux polygonal in a cross-section orthogonal to the longitudinal axis.

3. The assembly of claim 1, comprising a plurality of weights connected to the net and configured such that a rotation of the assembly causes the plurality of weights to be ejected from the housing, thereby unpacking the net into an expanded configuration, and wherein each weight of the plurality of weights protrudes from the housing when the net is in the packed configuration to provide the plurality of circumferentially disposed protrusions or ridges.

4. The assembly of claim 3, wherein the housing comprising a plurality of guides, each weight being disposed on a corresponding guide when the net is in the packed configuration, wherein the plurality of weights are configured to be ejected along the guides and from the housing by a rotation of the assembly, thereby unpacking the net into an expanded configuration.

5. The assembly of claim 3, comprising a release mechanism configured to controllably release the plurality of weights from the housing, and comprising at least one of:

at least one electromagnet configured to control release of the plurality of weights from the housing;

a timer for delaying a release of the plurality of weights from the housing;

an actuator configured to release the plurality of weights under remote control;

a collar configurable to release the plurality of weights;

a squib configured to release and/or expel the plurality of weights from the housing.

6. An assembly for use as a net-launching projectile, the assembly comprising:

a plurality of weights connected to a net; and a housing storing the net in a packed configuration, the housing comprising a plurality of guides, each weight being disposed on a corresponding guide when the net is in the packed configuration;

wherein the plurality of weights are configured to be ejected along the guides and from the housing by a rotation of the assembly, thereby unpacking the net into an expanded configuration.

7. The assembly of claim 6, wherein each guide comprises a channel extending from an opening in the housing, and wherein each channel extends towards a centre of the assembly; or each channel extends along a respective axis parallel to a radial path extending towards a centre of the assembly.

8. The assembly of claim 6, wherein each guide is configured to guide each weight to be ejected from the housing in:

a substantially radial direction or a direction parallel to a radial direction; or a direction between tangential and normal to an/the outer surface of the housing.

9. The assembly of claim 6, comprising a release mechanism configured to controllably release the plurality of weights from the housing, and comprising at least one of:

at least one electromagnet configured to control release of the plurality of weights from the housing;

a timer for delaying a release of the plurality of weights from the housing;

an actuator configured to release the plurality of weights under remote control;

a collar configurable to release the plurality of weights;

a squib configured to release and/or expel the plurality of weights from the housing.

10. A net-launching system comprising:

an assembly according to claim 1, and a launcher configured to launch the assembly from a barrel;

wherein the barrel is rifled to induce the rotation of the assembly when launched.

11. The net-launching system of claim 10, wherein:

the barrel is configured to engage with a/the plurality of circumferentially disposed protrusions or ridges on the assembly; and/or each protrusion or ridge of the plurality of protrusions or ridges is:

at least a portion of one of the plurality of weights; or provided on an/the elongate shaft of the housing of the assembly.

12. The net-launching system of claim 10, wherein at least one of:

the barrel is rifled with a plurality of channels or grooves for engaging with the plurality of circumferentially disposed protrusions or ridges on the assembly; and/or the barrel is rifled to comprise a substantially polygonal, rounded-corner polygonal or Reuleaux polygonal opening in cross-section corresponding to a cross-sectional shape of the assembly.

13. The net-launching system of claim 10, wherein the launcher is configured to eject the assembly from the barrel using a pressurized gas and/or a propellant.

14. The net-launching system of claim 10, comprising an Unmanned Aerial Vehicle (UAV), wherein the launcher is coupled to the UAV, and wherein at least one of:

the UAV is a fixed wind UAV; and/or the launcher is coupled to the UAV by a fixed or gimballed fixture.

* * * * *